US007210645B2

(12) United States Patent
Paterson et al.

(10) Patent No.: US 7,210,645 B2
(45) Date of Patent: May 1, 2007

(54) SAFETY ELEMENT RETENTION REEL

(76) Inventors: Richard M. Paterson, 413 Dixon Road, Newmarket Ontario (CA) L3Y 5C5; Patrick J. Kelly, 2555 Oak Row Crescent, Mississauga Ontario (CA) L5L 1P7

( * ) Notice: Subject to any disclaimer, the term of this patent is extended or adjusted under 35 U.S.C. 154(b) by 46 days.

(21) Appl. No.: 10/938,591

(22) Filed: Sep. 13, 2004

(65) Prior Publication Data

US 2006/0054730 A1 Mar. 16, 2006

(51) Int. Cl.
*B65H 75/48* (2006.01)

(52) U.S. Cl. ..... 242/383.4; 242/384.2; 242/396.4; 242/398

(58) Field of Classification Search ..... 242/382, 242/382.1, 382.2, 384.2, 383, 384, 384.5, 242/384.6, 385, 385.3, 396.1, 396.4, 398, 242/401, 608.7, 383.2, 383.4, 383.5, 385.1; 280/806, 807; 182/234, 239
See application file for complete search history.

(56) References Cited

U.S. PATENT DOCUMENTS

| | | | | |
|---|---|---|---|---|
| 2,341,491 | A * | 2/1944 | Tucker et al. | 242/608.7 |
| 3,442,466 | A * | 5/1969 | Fritsche | 242/379.1 |
| 4,513,952 | A * | 4/1985 | Vandelinde | 254/285 |
| 4,603,819 | A * | 8/1986 | Loose et al. | 242/379 |
| 4,726,541 | A | 2/1988 | Tsukamoto et al. | |
| 4,842,109 | A | 6/1989 | Avny | |
| 4,907,820 | A | 3/1990 | Föhl | |
| 4,948,066 | A | 8/1990 | Matsumoto et al. | |
| 5,287,950 | A | 2/1994 | Feathers et al. | |
| 6,279,682 | B1 * | 8/2001 | Feathers | 182/239 |
| 6,283,398 | B1 * | 9/2001 | Specht | 242/383.4 |
| 6,598,822 | B2 * | 7/2003 | Nagata et al. | 242/379.1 |
| 2002/0066818 | A1 | 6/2002 | Tanji et al. | |

* cited by examiner

*Primary Examiner*—Patrick Mackey
*Assistant Examiner*—William E. Dondero

(57) ABSTRACT

A safety element retention system having a reel upon which a safety element or strap may be wound, a spring return mechanism, for rewinding the reel and retrieving the safety strap, and further having at least one locking plate, connected integrally with the reel, with a locking hook associated with the reel, a ramp adjacent the hook, a locking dog adjacent to the hook and being swingable about a pivot axis, a damping device connected to said dog for slowing down movement a spring biassing the dog into a predetermined first position, and, a ramp follower member to contact the ramp on the locking plate, and cause the dog to move against the biassing force of the spring, into engagement with a hook on the locking plate, the biassing force of the spring causing swinging of the dog in the reverse direction, during normal operation, to remove the dog out from the path of the hook.

14 Claims, 6 Drawing Sheets

SAFETY ELEMENT RETENTION REEL

FIELD OF THE INVENTION

The invention relates to a storage and unwinding reel for a safety element, and in particular to a retention mechanism for incorporation in such a reel which stops the reel and retains the element in the event of an emergency.

BACKGROUND OF THE INVENTION

There are many situations in industry and in personal safety especially in the construction industry, where a safety element, or strap or tape or cord, is attached either to a person, or to an object. In many cases such safety straps are attached to reels. The reel permits the element to be unwound during normal movement so that the person can move, or object can be moved around in normal circumstances, and to perform normal tasks, without interference. The reel incorporates a rewind mechanism which maintains tension in the element and which rewinds the element into the reel to avoid leaving slack coils or lengths of the element, between the person or object and the reel. Usually the rewind mechanism is in the form of a clock spring which simply uncoils during extension of the element and which rewinds the element as it becomes slack.

In the event however of an emergency caused for example by a slip or fall, or failure of a piece of equipment, then the reel immediately locks to prevent further unwinding of the element, and thus prevents injury or damage. Similar safety element s are in wide use in vehicles, although operated on somewhat different principles.

One of the problems encountered with this type of operation is that, while the reel and element or tape will be operated regularly during normal operating conditions i.e. during safe movement, when the tape or retention cord is unwinding and rewinding slowly, the emergency for which it is designed may only arise, and it is hoped that will only arise, infrequently. Thus the locking mechanism intended to lock up the reel in the event of an emergency operation may be left inactive for months or years at a time.

During this time it may be liable to deterioration due to accumulation of dust, debris, and even rust, depending upon the materials of which it is made. Lubrication if required may have dried out long ago. Maintenance if required may not have been carried out.

One particular situation where a safety element system is required is in a school gymnasium. The gymnasium is usually equipped with basket ball nets. The nets are supported on a pair of parallel arms, in most cases. The arms can be swung upwardly so that the nets are out of the way. During use the arms can be swung downwardly, and the net can be set at various different heights, depending upon the age and skill of the players. These nets are operated by simple hoist systems, in many cases electrically operated hoist systems using a wire rope.

If the hoist fails the entire net and supporting arms can swing downwardly and create a hazard.

Safety regulations require the use of safety element s attached to the net mechanism.

The element s must be free to allow normal swinging of the nets but must stop the net from swinging down if there is a failure of the hoist or wire rope.

One known form of safety element reel is shown in U.S. Pat. No. 4,913,371.

It has a lock mechanism with lock bars 41 which are normally inactive. During normal use the lock bars 41 do not move. The lock bars 41 are intended to swing out and be activated by a sudden abrupt extension movement of the element. In fact the lock bars never move during normal operation of the net.

Over time due to inactivity of the lock bars, there is a possibility that the lock bars might become dusty or clogged and may not function when required.

To overcome this it is preferred that the locking mechanism shall be operated during regular operation of the system.

Preferably the locking apparatus will be such that it is operated repeatedly during normal use, and therefor remains loose and functional so that it is easily operated in the case of an emergency.

Preferably the unwinding of the element and reel will cause repeated operation of the locking mechanism, but in such a way that it does not become locked during normal operation.

When acceleration of the element is smooth and progressive the element can reach a considerable velocity, in the region of 5 ft/sec, before the reel is locked up.

A fundamental advantage of the invention is that the locking mechanism does not remain passive and inoperative, waiting for an emergency to occur, but is in fact operated continuously as the reel unwinds and rewinds, during normal use.

The locking mechanism actively checks the speed of rotation of the reel several times per revolution, the actual frequency being dependent upon the number of detents provided on the reel, as described below. This means that it is virtually impossible for the reel to exceed a safe speed of rotation. The mechanism has a "fail safe" feature, in that if there is a failure of any component the reel will lock.

The system is independent of gravity and can therefore be used in many different orientations without changing its operation.

While reference has particularly been made above to a safety element reel system for basket ball nets it will be appreciated that the invention described below is of much wider application and may be used in the construction of safety retention reels for element s and safety cords, and tapes in many different applications.

BRIEF SUMMARY OF THE INVENTION

With a view to providing a safety element retention system which overcomes many of these disadvantages the invention comprises a safety element retention system having a reel upon which a safety element such as a strap or cord or wire or the like may be wound, a spring return mechanism, for rewinding the reel and retrieving the safety element, and further comprising at least one locking plate, connected integrally with the reel, the locking plate defining a plurality of locking hooks and of plurality a ramp regions adjacent said hooks. The reel and at least one locking plate are mounted for location on a mounting frame. Mounted to the frame adjacent to the at least one locking plate, is a locking dog mechanism. The dog mechanism is connected to a mass, and is swingable about a pivot axis.

Spring means are incorporated biassing the dog into a predetermined first position, and a ramp follower member is connected the dog. The ramp follower member is adapted to contact the ramps on the locking plate, and cause the dog to move against the biassing force of the spring, into the path of one of the hooks on the locking plate, and wherein the biassing force of the spring is operable to cause swinging of the dog in the reverse direction, during normal operation, to remove the dog out from the path of the hook.

Preferably, the invention provides such a safety element retention system in which there is a drum or core, and there are two such locking plates, one on either side of the drum to comprise the reel.

Preferably, the invention provides such a safety element retention system wherein there are two such dogs, and two such followers, mounted together for swinging on a common pivot shaft.

Preferably, the invention provides such a safety element retention system wherein the mass is located between the two dogs and followers, and functions to retard the swinging movement of the dogs and ramp portions. In this way, during normal unwinding of the element and reel, the dogs are continuously moved into and out of the path of each of the hooks on the locking plates, but during sudden fast unwinding of the element the rotation of the reel will speed up and the inertia of the mass will be such as to damp or slow down the movement of the dogs. This will cause the dogs to engage and catch the next approaching hooks on the locking plates, and thus lock the reel.

Preferably, the invention provides such a safety element retention system wherein the mass is located between two plates, with two dogs and followers being defined by portions of the plates, and a bearing hole and pivot rod, extending through the two plates and the mass, to provide a rocking mount for the mass and plates.

Preferably, the invention provides such a safety element retention system wherein the reel and locking plates are contained within a housing, the housing defining first and second end plates, on opposite sides of the reel, and a side wall system connected between the two end plates by interconnecting tabs.

Preferably, the invention-provides such a safety element retention system in which an attachment clamp is provided, attachable to the housing, and which clamp is adapted to be positioned and configured so as to clamp around various different sizes and shapes of structures.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

As already explained the invention relates to a safety element retention system providing two basic functions namely the provision of a safety element such as a strap or cord which can be attached to a person, or an object, which under normal movement or operation can extend and allow the person or object to move around without restraint, and which is retracted again when the element or cord becomes slack, or is no longer required.

However, in the event of an emergency such as a fall, or breakdown in equipment the safety element retention system locks up and prevents further extension of the element or cord thereby avoiding further accident.

Figure 1:
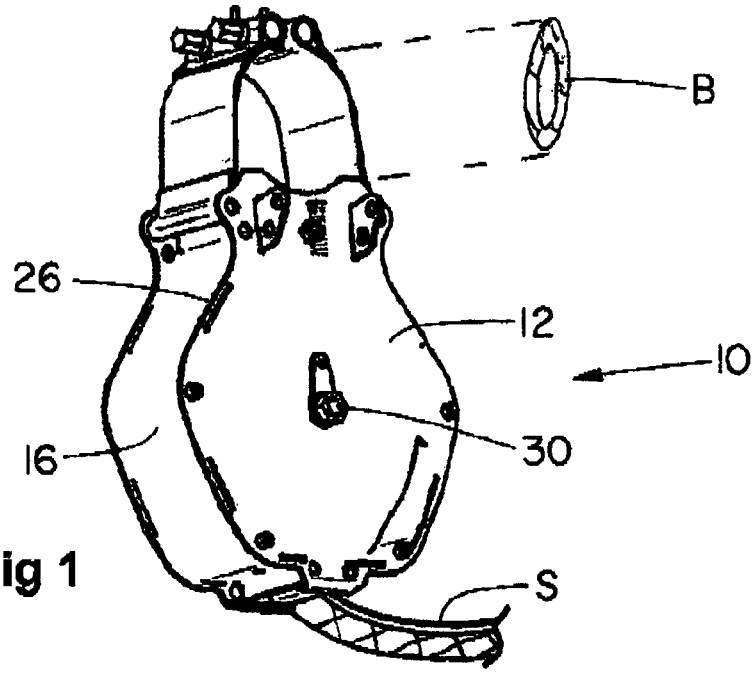
FIG. 1 is a perspective illustration of a safety element retention system illustrating the invention.
Figure 2:
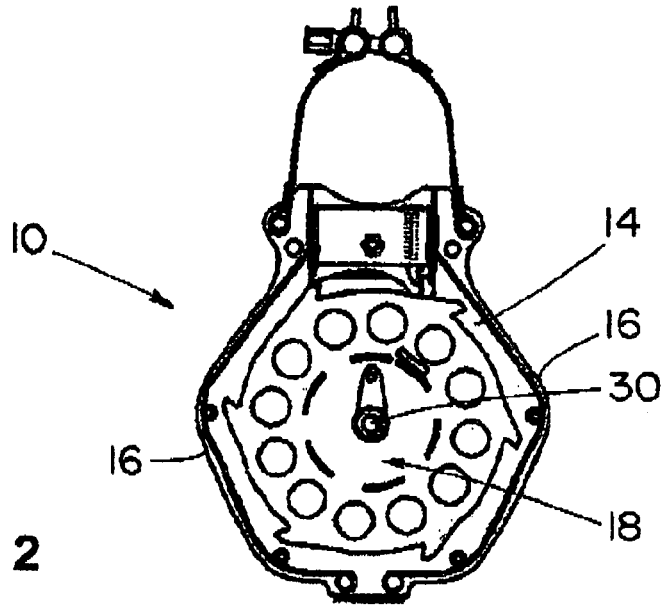
FIG. 2 is a section in front elevation along the line 2—2 of FIG. 1.
Figure 3:
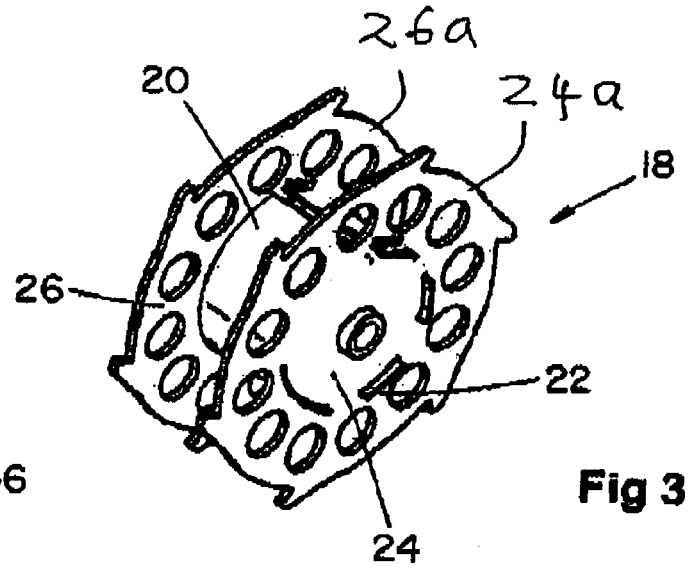
FIG. 3 is a perspective of the reel.
Figure 4:
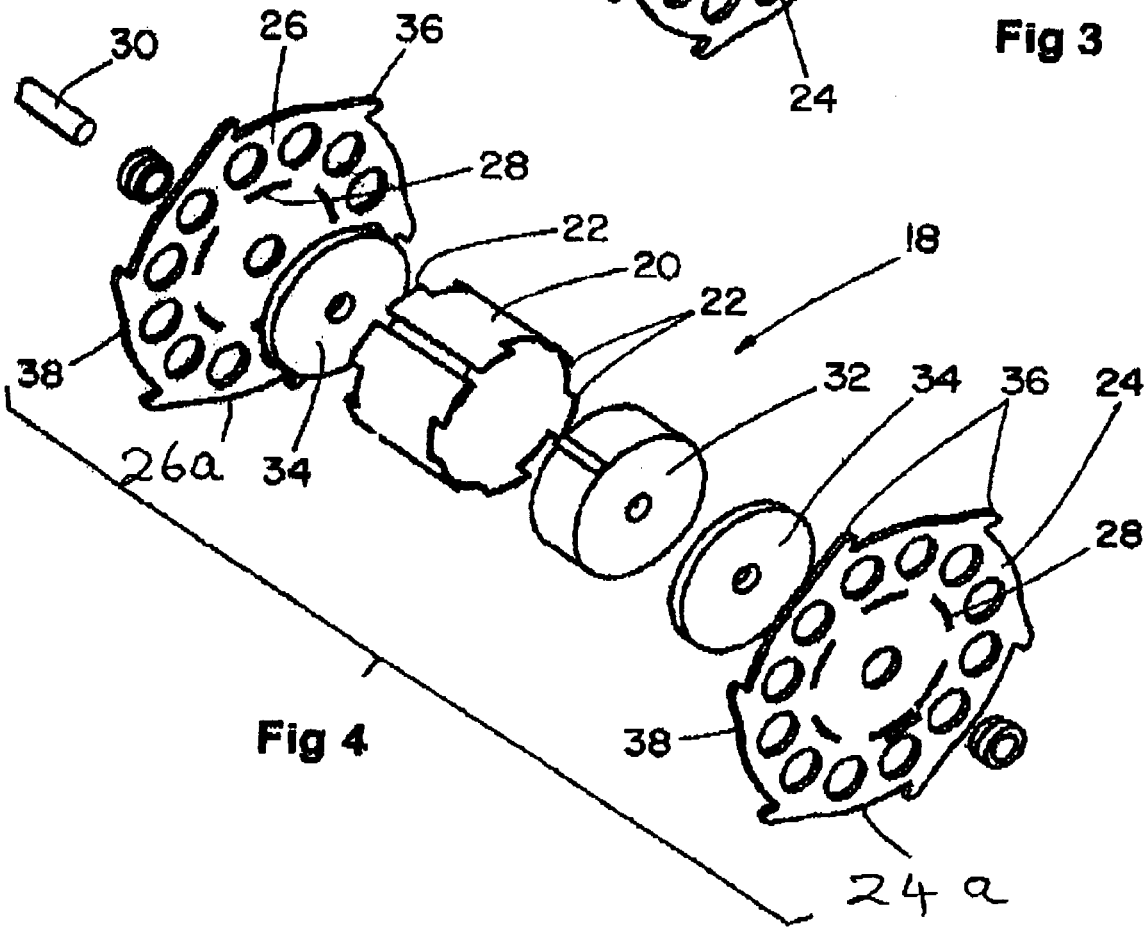
FIG. 4 is an exploded view of the reel components of the safety element retention system.
Figure 5:
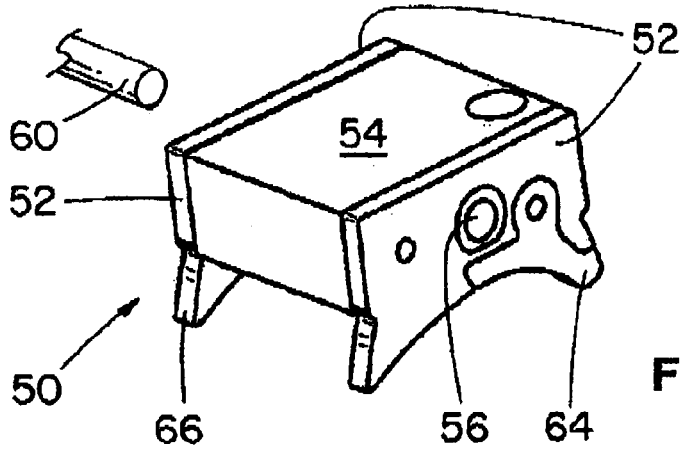
FIG. 5 is a perspective of the locking dogs and damping mass.
Figure 6:
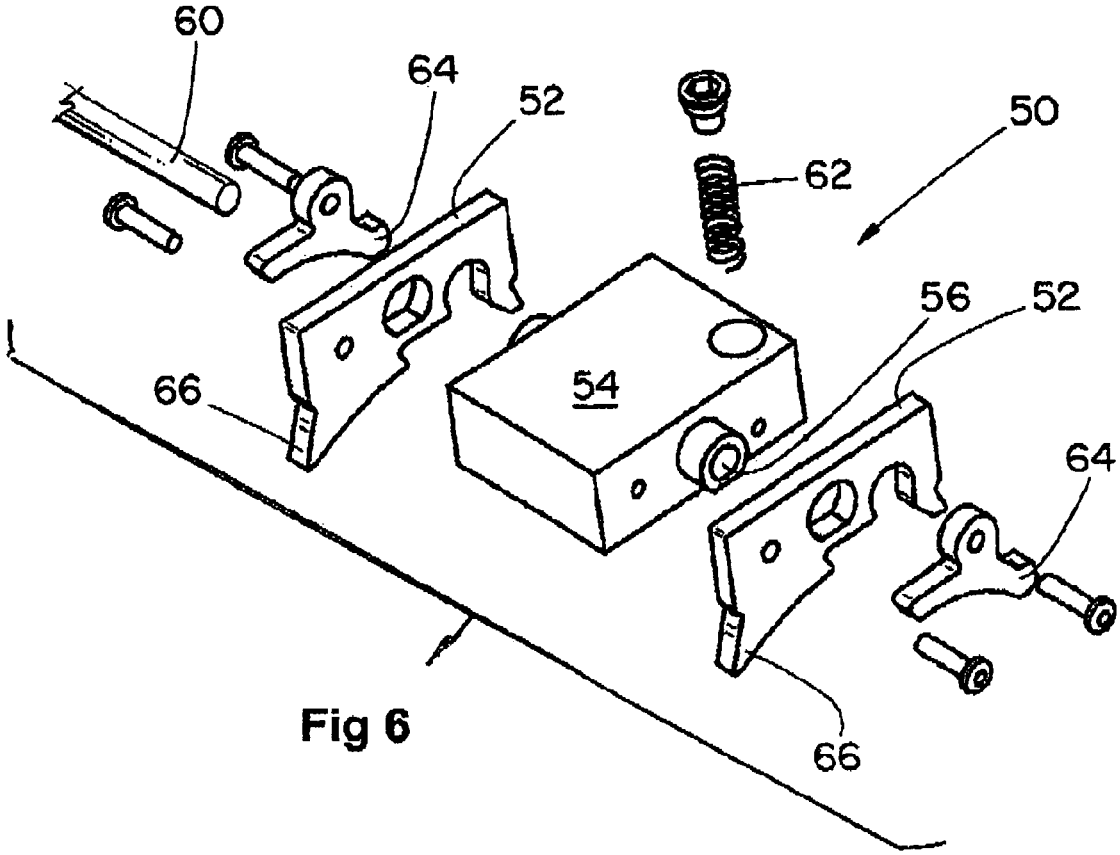
FIG. 6 is an exploded view of the locking dogs and damping mass.
Figure 7:
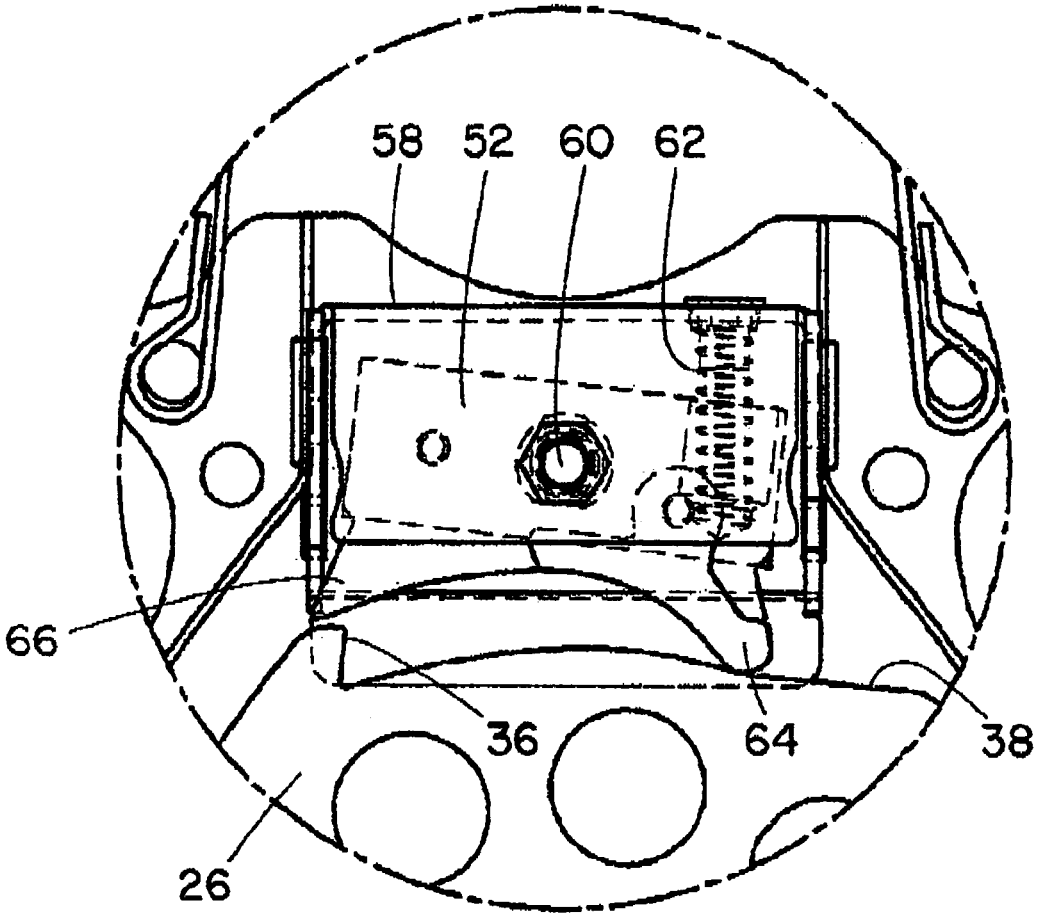
FIG. 7 is a an enlarged side elevation of the locking dogs and damping mass in position in the reel, and showing rocking movement in phantom.

As Illustrated generally in FIG. 1 the safety element retention system is illustrated generally as (10) which typically would be suspended on for example a structure such as a pipe or beam (B), or any other structure capable of providing a safe secure anchorage. The system (10) will have a housing comprising a front wail (12) and a back well (14), and two side walls (15) extending between the front and back wall. From within the housing, there extends, in this embodiment, an a safety element, which can be a strap, cord, wire rope, or tape (S), referred to herein collectively as "a safety element". Typically the safety element will be provided with means (not shown) for attaching it to en object, In this case, a moveable basket ball net assembly. It Will however be appreciated that such a safety element may be replaced by a safety tape or cord, and that the element may be used to be attached to almost any other moveable object, or to a person or individual requiring a safety element for example a construction worker, or for example an aircraft or ship crew member, or the like. In the case of an individual, the safety element retention system would be made on a different scale, more suitable for use in the work environment, but the principles of operation would be essentially the same as that described below.

Within the front and back walls (12) (14) of the housing, there is located a tape reel assembly indicated generally as (18). The tape reel assembly (18) consists of an interior cylindrical drum (20), having end tabs or flanges (22) for the reasons to be described below. On either side of the drum (20), in this embodiment there are provided two locking plates (24) (26).

The locking plates (24) (26) are provided with slotted openings (28) located around a generally circular path, for receiving the tabs (22) of the drum (20) and thereby forming the same into an integral moveable reel assembly. The tabs are bent eg at 90 degs. after insertion so as to hold the assembly together.

A spindle (30) extends from back wall (14), and passes through the drum (20) and through both locking plates (24) and (26). Within the drum (20) there is located a clock spring (32), of a type well known in the art. The clock spring (32) is attached by means not shown, to the spindle (30), at its inner end, and its outer end to the interior of the drum (20).

In this way when the tape reel assembly (18) rotates in one direction to extend the element s it will tend to wind up the spring (32), and when the tension on the element is released the spring (32) will then rewind the tape reel assembly (18) in the opposite direction thereby retrieving the element back into the housing. Discs (34) enclose spring (32) on either side.

The two locking plates (24) (26) are provided with locking hooks (36) around their perimeter. Locking hooks (36) are spaced apart from one another around the perimeter, and are separated by semi arcuate perimeter portions (24*a*) (26*a*). Ramps or cams (38) are provided adjacent to each on the outward directed sides of the hooks (36).

Adjacent to the tape reel assembly (18) there is mounted a swingable locking assembly (50).

Locking assembly (50) has two plates (52). Located between the two plates (52) there is a movement damping device, in this case a damping mass (54) of metal. A hole (56) passes through the plates (52) and mass (54).

A rectangular box housing (58) encloses the locking assembly (50). A pivot rod (60) passes through housing (58) and plates (52) and mass (54).

Plates (52) define locking dogs (66) and movement means in the form of followers (64).

Locking assembly (50) thus moves only between a locking position and an unlocking position.

Figure 9:
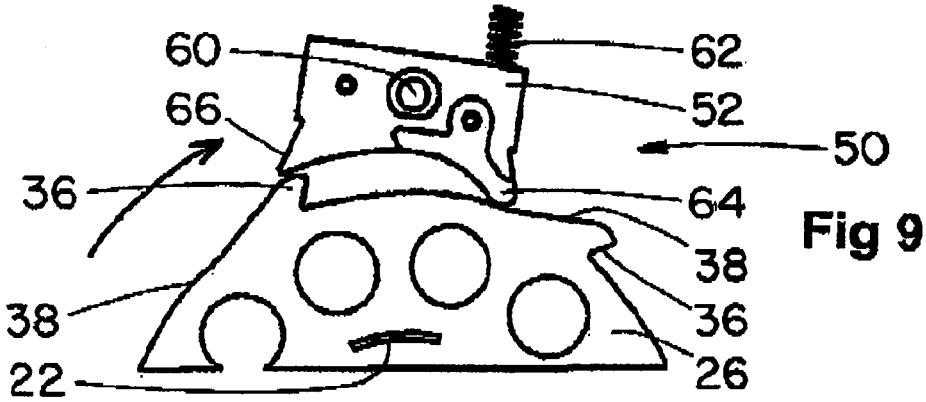
FIG. 9 is a schematic side elevation showing the locking dogs and reel in a second, normal unwind position.

A spring (62) is connected to locking assembly (50) and holds the locking assembly (50) in a normal at rest unlocking position. When the followers (64) rest on the ramps (38), on the backs of hooks (36), the locking dogs are swung downwardly against the spring pressure, into their locking position. As the tape reel assembly (18) unwinds, clockwise (FIG. 9 ), the tape extends from the assembly. During this normal movement the followers (64) start off in contact with the edges of locking plates (24–26) and ride on the ramps (38), and subsequently on hooks (36). In this position causes-spring (62) rocks to-rock dogs (66) about rod (60). This will cause the dogs (66) to swing up in their unlocking position out of the path of the approaching hooks (36) on plates (24) and (26). As the followers contact the ramps the hooks will then swing down, under the influence of ramps (38), against the spring pressure, into their locking position. This rocking movement in and out of the locking position is repeated for each hook and each ramp as the reel rotates.

As the tape reel assembly (18) unwinds, clockwise (FIG. 9), the tape extends from the assembly. During this normal movement the followers (64) remain in contact with the ramps (38). This permits the spring (62) to rock dogs (66) about rod (60). This will cause the dogs (66) to swing up out of the path of the approaching hooks (36) on plates (24) and (26).

Figure 8:
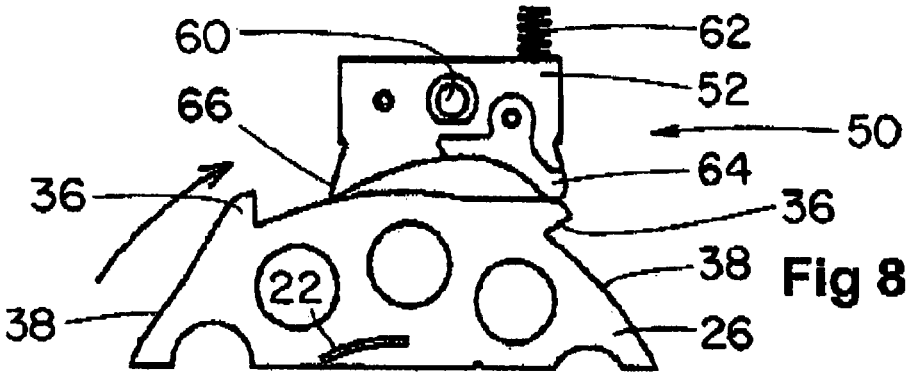
FIG. 8 is a schematic side elevation showing the locking dogs and reel in a first, normal unwind position.

When the tape reel assembly (18) is rotating at normal speed, the rocking movement of locking assembly (50) is relatively slow. The timing will allow spring (62) sufficient time to accelerate the mass (54) and swing the dogs (66) out of the path of the hooks (36), from the position of FIG. 8, into the position of FIG. 9.

Figure 10:
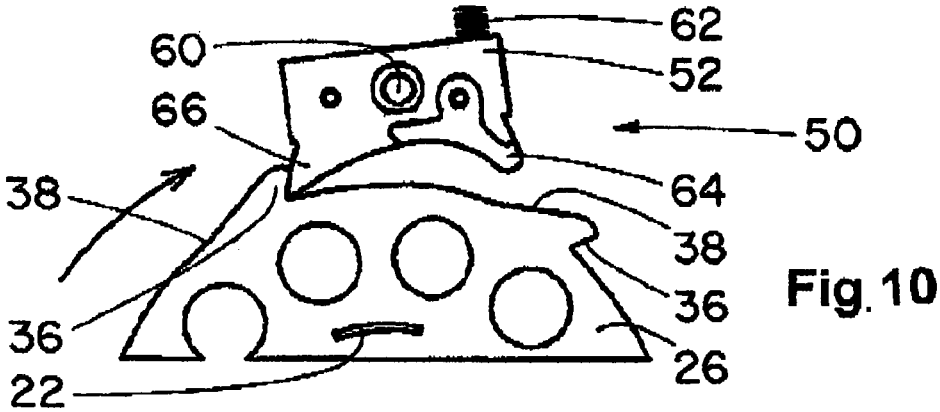
FIG. 10 is a schematic side elevation showing the locking dogs and reel in a third unwind position, corresponding to locking of the reel during an emergency.

However, if rotation of the tape reel assembly (18) is too fast, as in an emergency, then the damping effect of mass (54) will retard the spring (62), and it will not have sufficient time to rock dogs (66). As a result dogs (66) will be momentarily delayed in their locking position and will catch the next hooks (36), thereby locking the tape reel assembly (18) and stopping rotation, (FIG. 10), instantaneously.

Figure 11:
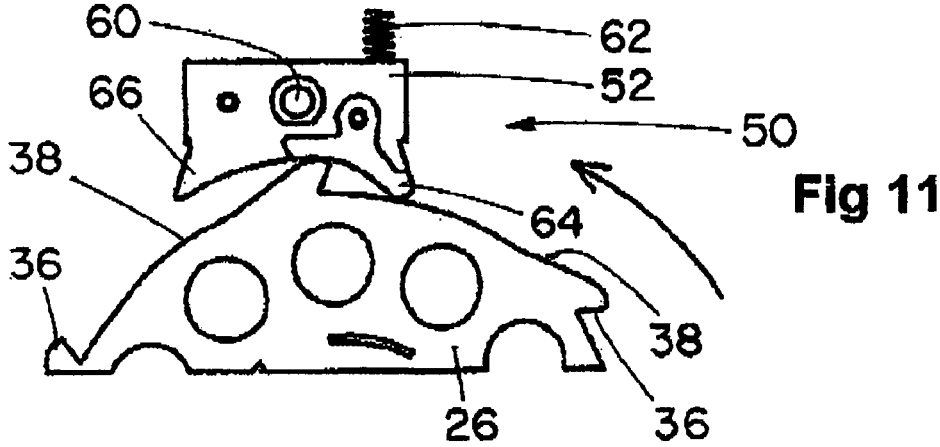
FIG. 11 is a schematic side elevation showing the locking dogs and reel in a rewind position.

If the spring (62) fails, the dogs (66) will always engage the next hook and provide a fail safe function. The internal clock spring (32) permits unwinding of tape reel assembly (18) (clockwise), as explained. However when the tape or element becomes slack or loses tension the clock spring causes rewinding of tape reel assembly (18) (anti-clockwise), (FIG. 11). The clock spring will thus procure rewinding of the element back onto the tape reel assembly (18). During rewinding, the follower (64) will simply ride up on each ramp (38), compressing spring (62), and will then drop back again as the hook (36) passes beneath the follower (64)

The advantage of this "see saw" type repetitive movement is that the locking assembly (50) is rocked on rod (60), several times on each revolution of the tape reel assembly (18) during normal operation.

This ensures that the mechanism will remain mobile and will not become clogged with dust etc. Even if the locking mechanism (50) does become clogged, and begins to seize, the ramps will still force the dogs into the path of the hooks and stop rotation.

Figure 12:
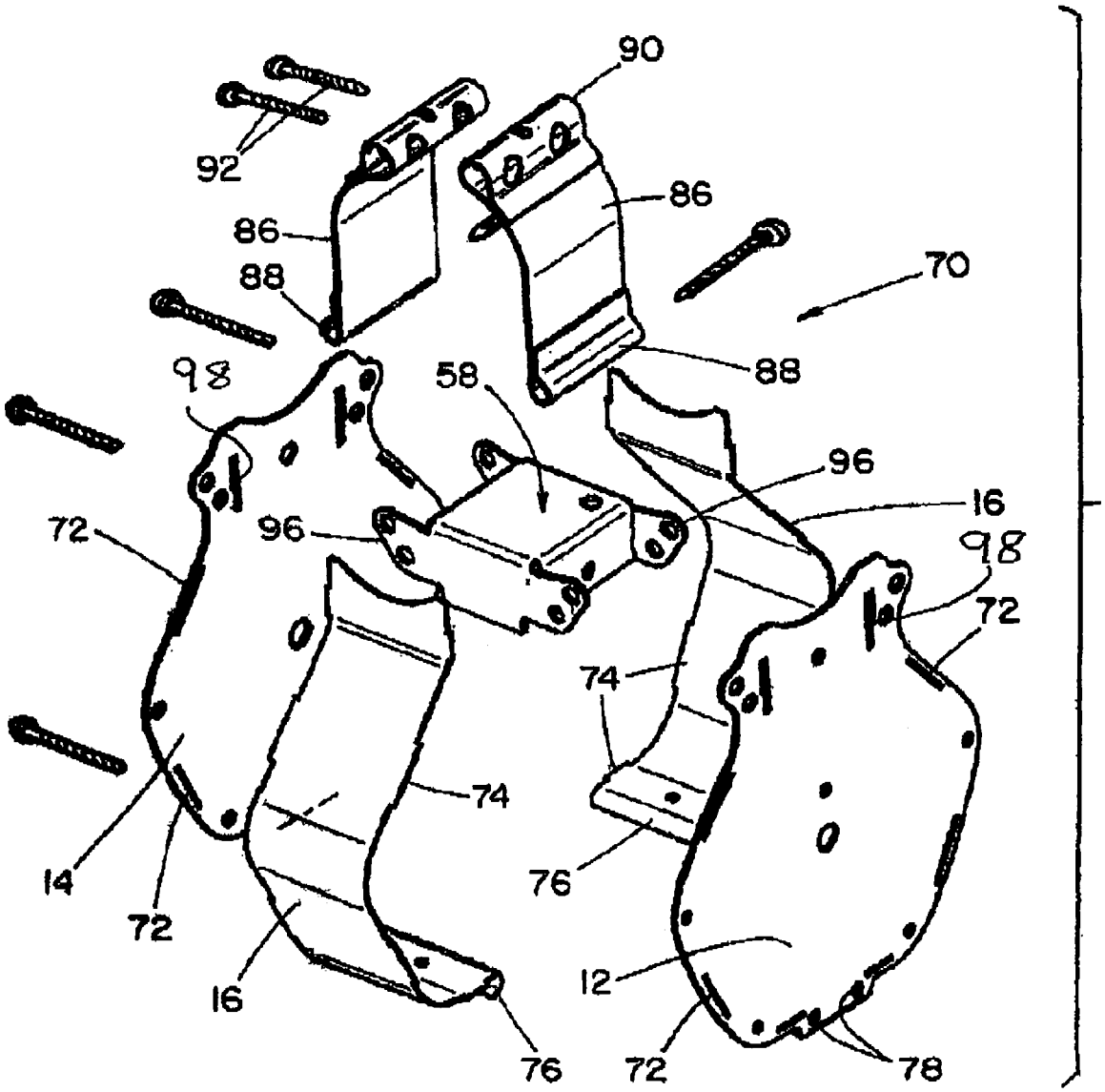
FIG. 12 is an exploded perspective of the housing

A housing (70) (FIG. 12) is provided for tape reel assembly (18). Front and rear walls (12) and (14) are formed with slots (72). Side walls (16) are formed with tabs (74) fitting in slots (72).

Bolt sleeves (76) register with holes (78) and permit the walls of the housing to be bolted together.

Hanger clamps (86) are provided, having lower bolt sleeves (88) by which they may be bolted to side walls (12) (14). Upper bolt sleeves (90) permit the upper ends of clamps (86) to be fastened together around some fixed structure, by bolts (92).

Clamps (86) are preferably somewhat contoured so as to fit around structure of various shapes. The bolt holes and sleeves enable to clamps to fit around structure of different dimensions. Bolt holes are provided at various positions to enable the clamps (86) to be arranged in various configurations.

Housing (58) is attached to housing (70) by tongues (96) which extend from opposite sides of housing (58) and pass through slots (95). systems similar to those described above. Plates (96) extend from opposite sides of housing (94).

Hangar plates (86) can be bolted to the plates (96) (FIG. 12) to provide for engaging a structure of smaller dimensions.

Typically the clamps would be secured around a structural beam or heavy pipe. As will be seen the clamps can also be attached either aligned with the sides of the housing, or rotated around an axis by 90 pegs.

This provides great flexibility in the way in which the system (10) can be installed in many different circumstances.

While reference has been made here to the damping action of the mass, it will be appreciated that such damping is for the purpose of slowing down the swinging of the dogs and ramps.

It is apparent that various means for supplying such damping function are available. An hydraulic damping system could be devised similar to a door closer. Pneumatic damping systems are known.

Even some resilient materials such as urethane have been used for damping rapid movements. Any of these systems could be adapted in the present case.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A safety element retention system having a reel upon which a safety element may be wound, and released under normal operation, and may be instantly stopped under emergency operation, and a rewind mechanism, for rewinding the reel and retrieving the safety element, and further comprising; at least one locking plate, connected integrally with and fixed permanently to the reel, and rotatably moveable simultaneously and coextensively therewith as a single unit, both during normal and emergency operation; a plurality of hooks associated with said at least one locking plate;

a plurality of ramp portions adjacent to respective said hooks;

a locking assembly, defining at least one locking dog, adjacent to said hooks and ramp portions, the locking assembly being swingable about a pivot axis between a locking position and an unlocking position;

a ramp follower connected to the locking assembly, being adapted to make contact with each of the hooks and ramp portions on the locking plate repeatedly in sequence as said locking plate rotates, and wherein each such contact causes the locking assembly in response to contact with each said hook to swing repeatedly into the locking position, bringing the locking dog into the path of each of the hooks on the locking plate in sequence, and wherein contact of said ramp follower with said ramp portions permits said locking assembly to swing into the unlocking position removing the locking dog out of the path of each hook on the locking plate, in sequence;

a biasing spring device connected to the locking assembly to cause said ramp follower to contact said ramp portions, in sequence, thereby repeatedly swinging of the locking assembly, during normal operation, to remove the locking dog out of the path of each said hook in sequence as the locking plate rotates, and a mass damping device connected to said locking assembly for momentarily retarding movement thereof, during abrupt emergency operation whereby said mass damping device delays said biasing spring device and delays swinging movement of said locking assembly from said locking position to said unlocking position and thus causes said locking dog on said locking assembly to remain in the path of a hook on the locking plate and to engage said hook, and cause simultaneous stopping of said locking plate and said reel.

2. A safety element retention reel as claimed in claim 1 in which there is a drum and two such locking plates, one on either side of the drum.

3. A safety element retention reel as claimed in claim 1 wherein the locking assembly includes two locking dogs, mounted together for swinging on a common pivot shaft.

4. A safety element retention reel as claimed in claim 3 wherein said ramp follower includes two ramp followers, for engaging the locking plate, the locking assembly and the followers being mounted together for swinging on a common pivot shaft.

5. A safety element retention reel as claimed in claim 4 wherein, the mass is located between the two locking dogs and followers, and functions to delay the swinging movement of the locking assembly, as aforesaid.

6. A safety element retention reel as claimed in claim 1 wherein said damping device comprises a damping mass, incorporated in said locking assembly and functions to retard the swinging movement of the locking assembly.

7. A safety element retention reel as claimed in claim 1 wherein the reel and locking plate are contained within a housing, the housing defining first and second end plates, on opposite sides of the reel, and a side wall system connected between the two end plates.

8. A safety element retention reel as claimed in claim 1 in which an attachment clamp is provided, said clamp being adapted to be positioned and configured so as to clamp around various different sizes and shapes of structures.

9. A safety element retention system for dispensing of and retrieval of a safety element which may be stopped under emergency operation and comprising;

a reel upon which a safety element may be wound, and rotatable to unwind and rewind said element;

a spring return mechanism, for rewinding the reel and retrieving the safety element; at least one locking plate, connected integrally with the reel, and moveable simultaneously and coextensively therewith, both during normal and emergency operation;

a plurality of locking hooks associated with said locking plate arranged radially spaced apart therearound;

a plurality of ramp portions defined by portions of said locking plate adjacent said hooks; peripheral plate edge portions of said locking plate between each said ramp portion and the next adjacent hook being defined by generally arcuate profiles around a circular arc and extending from one said hook to the ramp portion of the next adjacent hook;

a locking assembly, adjacent to said hooks, the locking assembly defining a plurality of locking dogs and being swingable about a pivot axis between locking and unlocking positions;

a biasing spring device connected to the locking assembly so as to apply spring force biasing the locking assembly into its unlocking position; and, a ramp follower member connected to the locking assembly the ramp follower member being adapted to make contact with each of the hooks on said locking plate, and cause the locking assembly to move against the biasing force of the spring, into its locking position whereby to procure movement of the locking dog into the path of one of the hooks on the locking plate, and said ramp follower member being further adapted to ride on said ramp portions and on said peripheral plate edges portions, thereby permitting the biasing force of the spring to cause swinging of the locking assembly removing the locking dog out of the path of said hook; and a mass weight damping device connected to said locking assembly retarding swinging movement thereof, whereby during abrupt emergency operation said mass weight damping device momentarily delays said biasing spring and delays swinging of said locking assembly from its said locking position and permits said locking dogs on said locking assembly to engage a hook, and cause instant simultaneous stopping of said locking plate and said reel.

10. A safety element retention system as claimed in claim 9 wherein there are two said locking plates one on each side of said reel, and wherein each said locking plate defines identical hooks arranged in pairs and wherein said locking assembly is adapted to engage a said pair of hooks.

11. A safety element retention system as claimed in claim 10 wherein the damping device comprises a mass of metal, and a pivot mount therefor permitting said mass to swing about a pivot axis.

12. A safety element retention system as claimed in claim 9 wherein there are two locking dogs and two ramp followers, oriented to engage respective locking plates on opposite sides of said reel.

13. A safety element retention system as claimed in claim 9 and including a housing for said reel, said housing having front and back plates, and side plates between said front and back plates, and slots in said front and back plates and tongues on said side plates engaged with said slots for holding said housing together.

14. A safety element retention system as claimed in claim 9 wherein said housing further comprises a pair of hanger clamps swingably secured in spaced apart relation on said housing, and threaded devices for clamping said clamping plates around an object.

* * * * *